United States Patent [19]

Hahn

[11] Patent Number: 4,521,010

[45] Date of Patent: Jun. 4, 1985

[54] EXERCISER TENSION DEVICE ASSEMBLY

[76] Inventor: Daniel G. Hahn, 1040 E. North Ave., Olney, Ill. 62450

[21] Appl. No.: 523,278

[22] Filed: Aug. 15, 1983

[51] Int. Cl.[3] ..... A63B 69/16

[52] U.S. Cl. ..... 272/73; 272/116; 272/131; 272/132

[58] Field of Search ..... 272/73, 131, 132, 116

[56] References Cited

U.S. PATENT DOCUMENTS

| | | | |
|---|---|---|---|
| 4,206,914 | 6/1980 | Lee | 272/73 |
| 4,364,557 | 12/1982 | Serati | 272/73 |
| 4,463,945 | 8/1984 | Spector | 272/73 |

*Primary Examiner*—Richard J. Apley
*Assistant Examiner*—Kathleen J. D'Arrigo
*Attorney, Agent, or Firm*—Polster, Polster and Lucchesi

[57] ABSTRACT

In a "bicycle" type exerciser in which a wheel on which a tire is mounted is supported for rotation off of the ground between two spaced legs of a fork, and a tension device is mounted to apply a selected braking force to the wheel, a head plate extending between and secured to the fork legs above the wheel has at its lower edge an outturned lip. A down tube is secured at its upper end to the head plate and extends downwardly from a position above the wheel in a direction rearwardly away from the wheel. A yoke, U-shaped in plan view, has two arms embracing the down tube and a bridging section between them at one end of the arms extending across the down tube. A tension wheel is mounted between the arms at their free ends. Each of the arms has a knuckle member engaging the lip of the head plate to form a hinge connection. A tension screw, with a knob on its outer end, is threaded through the bridging section and extends through a slot in the upper surface of the down tube to engage the lower inside surface of the down tube and to rock the yoke about the hinge to move the tension wheel into tighter or looser engagement with the wheel.

10 Claims, 3 Drawing Figures

EXERCISER TENSION DEVICE ASSEMBLY

BACKGROUND OF THE INVENTION

In exercisers of the bicycle type known heretofore, in which a tension wheel has been used as the means for selectively braking the exerciser wheel, the tension wheel has been mounted on a bracket that has been pivotally mounted between the legs of the exerciser fork by means of an axle pin extending through holes in the legs of the fork and holes in legs of the bracket. This required, among other things, forming holes in the tubular legs of the fork and ensuring their alignment, and a number of parts for assembly.

One of the objects of this invention is to provide a simplified tension device assembly that not only requires fewer parts and is more easily manufactured and assembled than tension assemblies known heretofore, but eliminates the necessity for forming holes in the tubular legs of the frame.

Other objects will become apparent to those skilled in the art in the light of the following description and accompanying drawing.

SUMMARY OF THE INVENTION

In accordance with this invention, generally stated, a bicycle type exerciser is provided with a head plate extending between and secured to the legs of a fork in which the exerciser wheel is mounted, the plate having at its lower edge a outturned lip. A down tube, secured at its upper end to the head plate, extends downwardly from a position above the wheel in a direction away from the wheel. A yoke, U-shaped in plan, with two arms and a bridging section between them at one end, embraces the down tube. The yoke has means for mounting a braking element between the arms at their free end, and intermediate the free end and the bridging section, knuckle members engaging the lip of the head plate to form a hinge connection between the plate and the yoke. Means are provided between the down tube and the bridging section for selectively rocking the yoke about the hinge to move the braking element into tighter or looser engagement with the wheel. In the preferred embodiment, the braking element is a tension wheel, and the knuckles are integral with the arms and take the form of a finger defining a part of a J-slot opening upwardly through the edge of each arm.

DESCRIPTION OF THE PREFERRED EMBODIMENT

Figure 1:
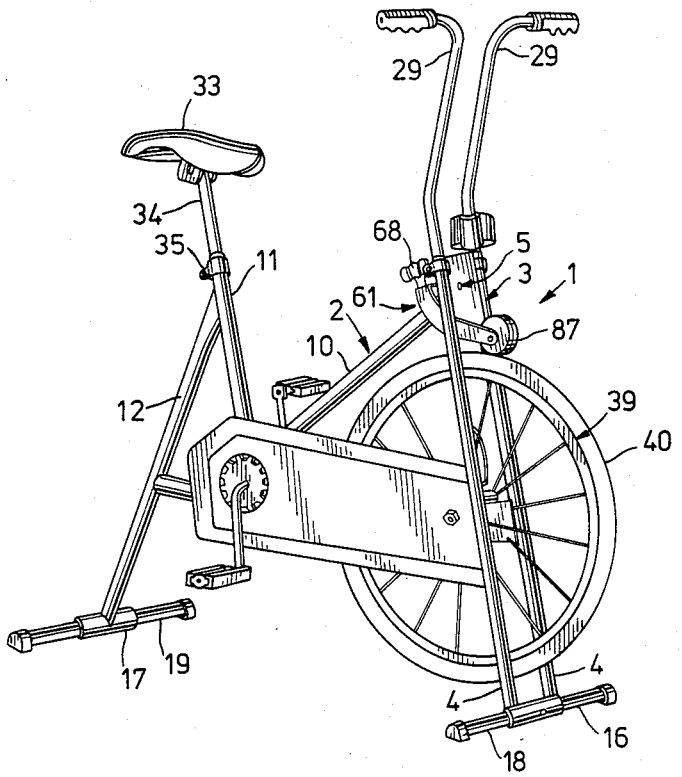
FIG. 1 is a view in perspective of an exerciser equipped with one embodiment of tension device assembly of this invention.

Referring now to the drawing for one illustrative embodiment of exerciser tension device assembly of this invention, reference numeral 1 indicates an exerciser of the bicycle type. The exercizer 1 has a tubular frame 2 that includes a fork 3, with legs 4 and a head plate 5, a down tube 10, welded at its upper end to the back side of the head plate 5, a seat mast 11 and a rear brace 12. A front cross member tube 16 is welded to the lower ends of the legs 4, and a rear cross member 17 is welded to the lower end of the rear brace 12. A front stabilizer bar 18 is mounted in and extends at both ends beyond the front cross member 16, and a rear stabilizer bar 19 is mounted in the rear cross member 17 and extends at both ends beyond it.

A crank hanger 25 is secured, as by welding, to the underside of the down tube 10.

The legs 4 are slotted at their open upper ends, and handlebars 29 are adjustably mounted in them and held in the desired position by means of handlebar clamps 30. A saddle 33 is mounted on the upper end of a seat post 34 that is slidably mounted in the seat mast 11 and held by a seat post clamp 35.

A wheel 39 with a tire 40 is mounted on an axle 41 which in turn is mounted in a slot in a drop out plate 42. The wheel has a conventional wheel sprocket, not here shown.

A drive sprocket 44 is secured to an axle shaft part of a crank assembly 45. The crank assembly is rotatably mounted in the crank hanger, and a chain 46, tending around the drive sprocket and the wheel speocket, transmits force from the drive sprocket to the wheel sprocket in the conventional way.

In this embodiment, the head plate 5 has at its lower edge, which is perpendicular to the plane defined by the down tube and seat mast, a lip 50, tending forwardly. The lip 50 has leading edges 51 on either side of a central tongue 55. The tongue 55 has side edges 56 and a front edge 57, all as shown in FIG. 2.

A tension wheel assembly 60 includes a yoke 61 made up of parallel arms 62 and 63 joined at one end by a connecting section 64. The connecting section has a central internally threaded hole 65 to take a threaded stem 67 of a tension knob assembly 66 that includes a knob 68 at the outer end of the stem 67. Each of the arms 62 and 63 has an inner straight section 72 tending from the connecting section 64 and an outer straight section 73, the inner and outer sections 72 and 73 being joined by a curved section 74. A J-slot 77, with a mouth 78 opening through the upper edge of the outer section 73, is defined in part, at its closed end, by a finger 80. Near their outer ends, the arms 62 and 63 have holes 83 aligned to receive a tension wheel axle 85, upon which a tension wheel 87 is rotatably mounted. Spring fasteners 89 mounted on the ends of the axle projecting through and beyond the holes 83, hold the axle in place.

Figure 3:
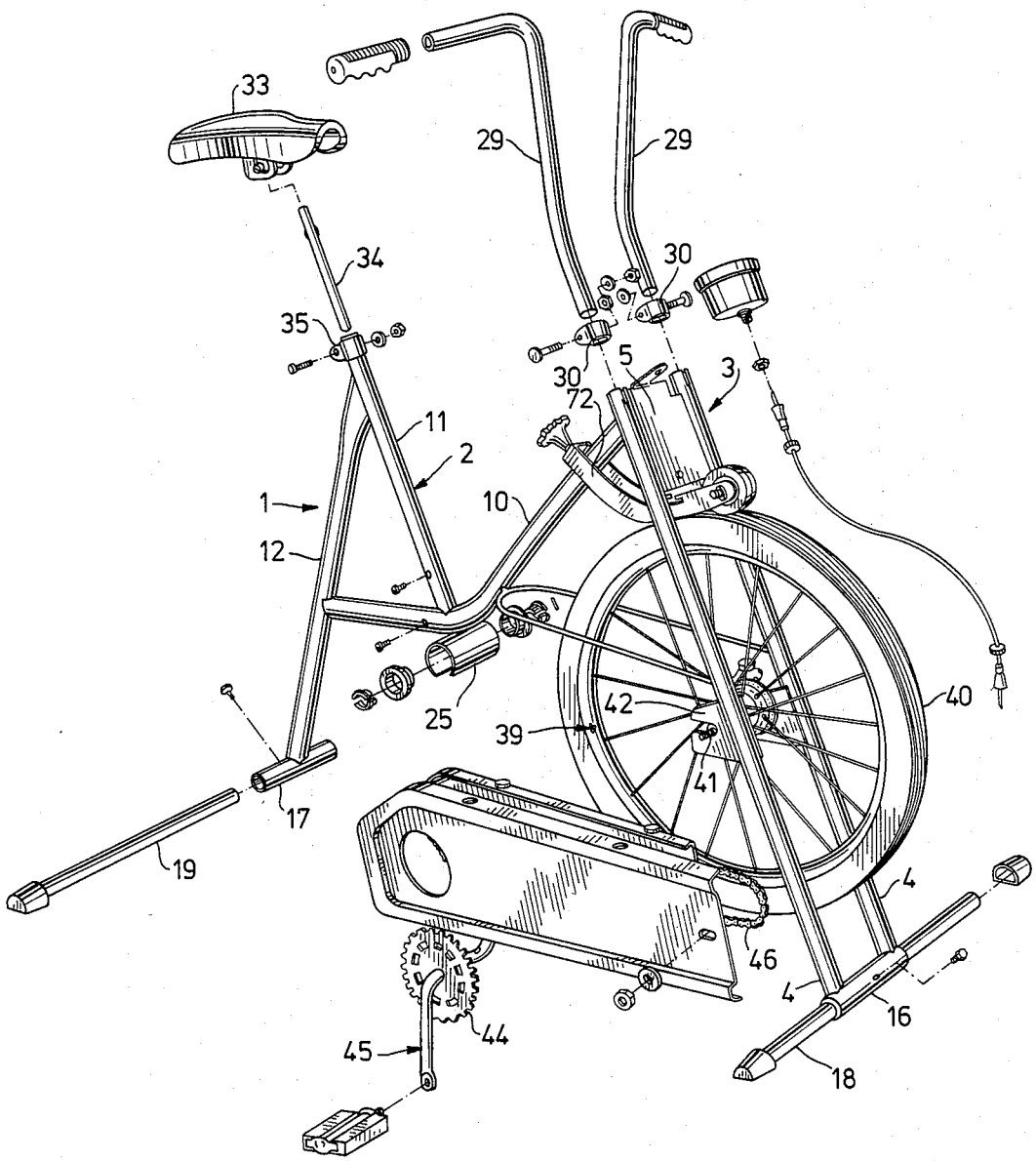
FIG. 3 is an exploded view in perspective, somewhat enlarged, of the exercise device shown in FIG. 1.

The curved section 74 of the arms 62 and 63 is such that when the tension wheel assembly is mounted, with the yoke embracing the down tube 10, the shank 67 of the tension knob assembly passes through a slot in the upper surface of the down tube 10 and bears substantially diametrically upon the lower interior surface of the down tube perpendicularly to the long axis of the down tube, as shown particularly in FIG. 3.

Figure 2:
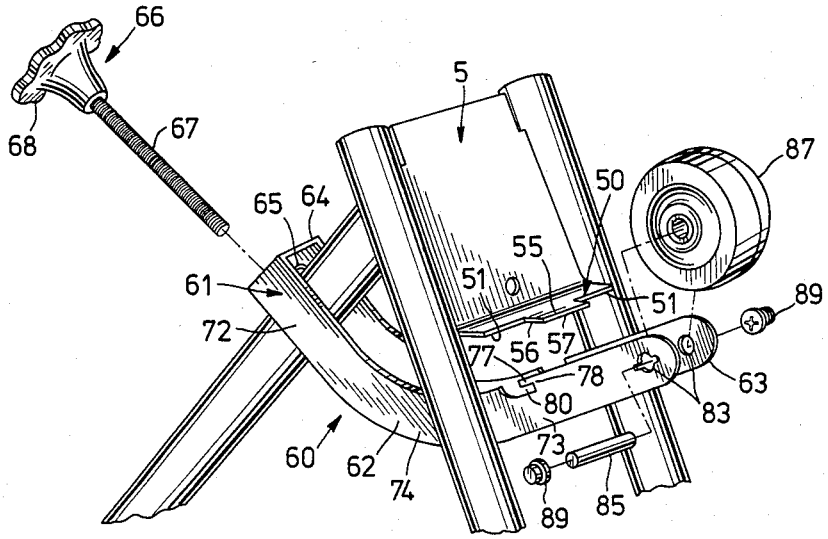
FIG. 2 is an enlarged fragmentary exploded view in perspective of the tension device assembly shown in FIG. 1.

In assembling the exercise tension device, the yoke 61 is placed in the position shown in FIG. 2 and the tension wheel 87 is mounted between the arms. The fingers 80 are hooked over the leading edges 51 of the lip 50, with the tongue 55 between the arms 62 and 63, the side edges 56 of the tongue serving as locating and guide members for the yoke. The threaded stem 67 of the knob assembly 66 is threaded through the internally threaded hole 65 and screwed down until the tension wheel 87 engages the tire 40 of the wheel 39.

No other mounting means or spring is required. The fingers 80 serve the function of the knuckle of a hinge, with the upper surfaces of the lip 51 on either side of the tongue 55 serving as the pintle. The yoke 61 need be rocked only a short distance around the hinge formed by the pintle and knuckles in response to the screwing in or out of the threaded stem of the knob assembly to produce the ranges of braking force required.

It can be seen that the yoke can be made of sheet stock, with the J-slots 77, hole 65 and tension wheel axle holes 83 punched in the process of forming the yoke. Similarly the head plate 5 can be made on a punch press and the lip 50 formed and bent out easily.

The device of this invention permits double utilization of the head plate 5, makes it unnecessary to form aigned holes in the tubular legs 4, thus facilitating the manufacture and assembly of the legs and increasing their strength, and eliminates the need for another axle and retaining means for it.

Numerous variations in the construction of the device of this invention, within the scope of the appended claims, will occur to those skilled in the art in the light of the foregoing disclosure. Merely by way of example, a nut or other internally threaded member can be secured to the bridging section 65 to receive the threaded stem 67. Different tensioning means from the tensioning wheel 87 may be employed, such as a simple drag pad. A bearing plate can be welded or otherwise mounted to the top of the down tube 10, upon which the end of the stem 67 can bear, in which case, the bearing plate will be considered a part of the down tube. The tongue 55 can be omitted, although it serves a useful function. The finger 80, and the J-slot 77 can be differently configured. A different means for rocking the yoke 61 can be used, such as a sliding wedge, although the tension knob assembly shown and described is simple and effective. These are merely illustrative.

I claim:

1. In a bicycle type exerciser in which a wheel on which a tire is mounted is supported for rotation off the ground between two spaced legs of a fork, the improvement comprising a head plate extending between and secured to said fork legs above said wheel, said plate having at its lower edge an outturned lip; a down tube secured at its upper end to said head plate and extending from a position above said wheel downwardly in a direction away from said wheel, and means for braking said wheel adjustably through a range of resistance, said means comprising a yoke, U-shaped in plan, having two arms and a bridging section between them at one end of said arms, said bridging section extending across said down tube on a side of said down tube away from said wheel and said arms having at their free ends means for mounting a braking element between them to engage said wheel, each of said arms having a knuckle member engaging said lip to form a hinge connection between said plate and said yoke, and means extending between said down tube and said bridging section for selectively rocking said yoke about said hinge connection to move said braking element into tighter or looser engagement with said wheel.

2. The improvement of claim 1, wherein said lip has a central tongue projecting from its free edge, said tongue projecting between the arms of said yoke to prevent lateral shifting of said yoke with respect to said wheel.

3. The improvement of claim 1 wherein said knuckle members are integral with said arms.

4. The improvement of claim 3 wherein each knuckle is constituted by a finger defining a part of a J-slot opening upwardly through the upper edge of said arm at an end of the slot toward said bridging section.

5. The improvement of claim 4 wherein the means for rocking said yoke comprise internally threaded means on said bridging section and an externally threaded stem mounted therein, the inner end of said stem bearing against a surface of said down tube.

6. The improvement of claim 1 wherein the braking element is a tension wheel.

7. The improvement of claim 5 wherein said lip, fingers and stem constitute the sole mounting means for said yoke, whereby, when said stem is unscrewed, the knuckle can be moved to clear the lip.

8. The improvement of claim 1 wherein the legs of the fork between their lower ends and the head plate are unperforated.

9. The improvement of claim 1 wherein the yoke is formed of sheet stock.

10. In a bicycle type exerciser in which a wheel on which a tire is mounted is supported for rotation off the ground between two spaced legs of a fork, the improvement comprising a head plate extending between and secured to said fork legs above said wheel, said plate having at its lower edge an outturned lip including a central tongue projecting from its free edge; a down tube secured at its upper end to said head plate and extending from a position above said wheel downwardly in a direction away from said wheel, and means for braking said wheel adjustably through a range of resistance, said means comprising a yoke, U-shaped in plan, having two arms and a bridging section between them at one end of said arms, said bridging section extending across said down tube on a side of said down tube away from said wheel and said arms having at their free ends means for mounting a tension wheel between them to engage said wheel, each of said arm having integral with it a knuckle member, constituted by a finger defining a part of a J-slot opening upwardly through the upper edge of said arm at an end of the slot toward said bridging section, engaging said lip and straddling said tongue to form a hinge connection between said plate and said yoke, and means comprising an internally threaded member on said bridging section and a threaded stem mounted therein and extending between said down tube and said bridging section for selectively rocking said yoke about said hinge connection to move said tension wheel into tighter or looser engagement with said wheel.

* * * * *